United States Patent [19]

Bodig

[11] 4,246,881

[45] Jan. 27, 1981

[54] SYSTEM FOR DECREASING THE POWER CONSUMPTION IN THE OUTPUT TRANSISTOR OF AN IGNITION SYSTEM

[75] Inventor: Bernd Bodig, Leinfelden, Fed. Rep. of Germany

[73] Assignee: Robert Bosch GmbH, Stuttgart, Fed. Rep. of Germany

[21] Appl. No.: 54,288

[22] Filed: Jul. 2, 1979

[30] Foreign Application Priority Data

Jul. 7, 1978 [DE] Fed. Rep. of Germany ..... 2829828

[51] Int. Cl.[3] ..... F02P 3/04

[52] U.S. Cl. ..... 123/644; 123/656

[58] Field of Search ..... 123/148 E

[56] References Cited

U.S. PATENT DOCUMENTS 3,575,154 4/1971 Taylor ..... 123/148 E

FOREIGN PATENT DOCUMENTS 2406018 8/1974 Fed. Rep. of Germany .

*Primary Examiner*—Tony M. Argenbright

*Attorney, Agent, or Firm*—Frishauf, Holtz, Goodman & Woodward

[57] ABSTRACT

When the current through the primary winding of an ignition coil of an ignition system in an internal combustion engine has increased to a predetermined value, base current for a power transistor connected in series with the coil is shunted away, causing a rise in voltage across the primary winding. When the voltage rise across the primary winding has reached a maximum allowable value less than the value required to cause the generation of a spark, the transistor is switched back to the fully conductive state. This cycle is repeated during the time the transistor would normally be conductive and terminates at the ignition time, that is at the time the transistor is blocked by the ignition timing circuit of the internal combustion engine to create the spark.

5 Claims, 2 Drawing Figures

Figure 1:
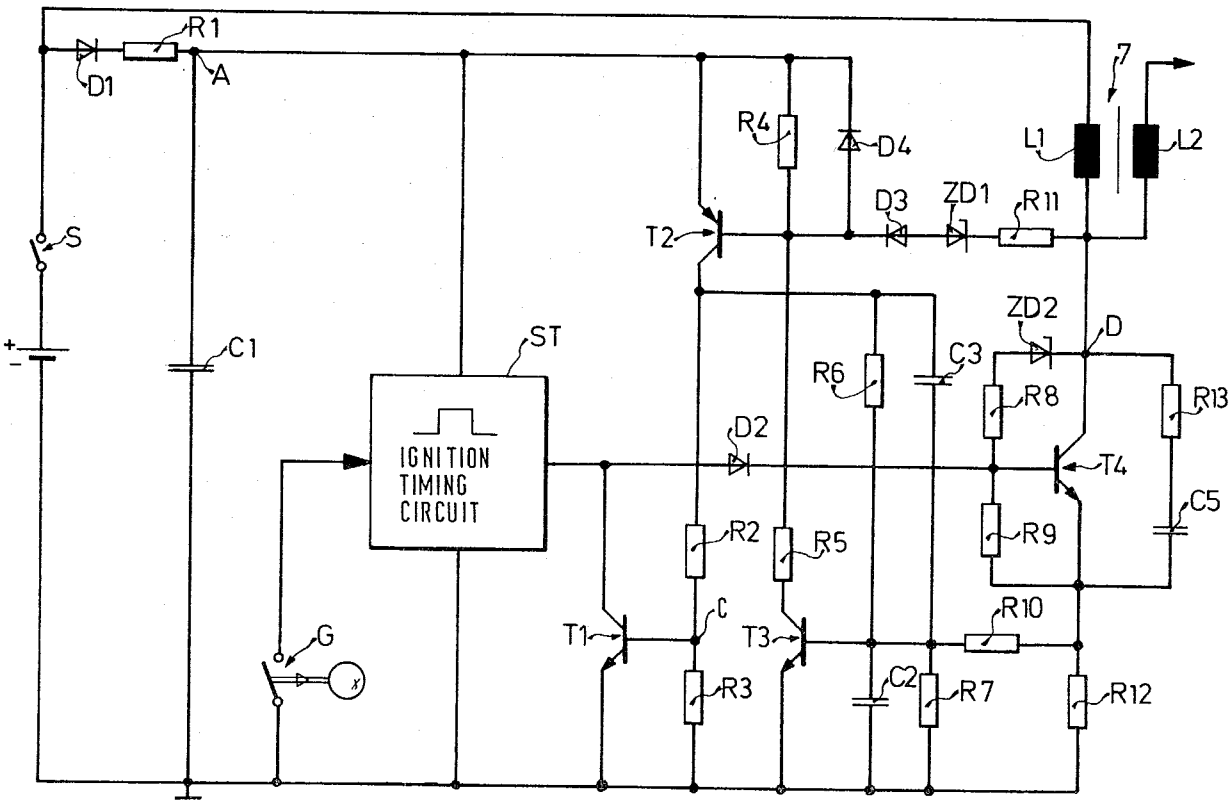

SYSTEM FOR DECREASING THE POWER CONSUMPTION IN THE OUTPUT TRANSISTOR OF AN IGNITION SYSTEM

The present invention relates to ignition systems in internal combustion engines and, more particularly, to ignition systems wherein a current control transistor (power output transistor) is connected in series with the primary winding of the ignition coil for controlling the current flowing therethrough and wherein, further, a resistor is connected in series with the emitter-collector circuit of the transistor to furnish a signal indicative of the amplitude of current flowing through the primary winding of the ignition coil.

BACKGROUND AND PRIOR ART

In known ignition systems of the above-described type, as, for example, disclosed in DE-OS 25 49 586, when the voltage across the resistor reaches a predetermined voltage indicative of sufficient current flow through the primary winding for energy storage in the ignition coil, this voltage causes another transistor in the circuit to become conductive, causing part of the base current from the power transistor to be shunted. This prevents further current increase in the primary winding.

It is a disadvantage of this type of current control that high losses occur in the power output transistor during the time that its conductivity is decreased. This results in the requirement for a relatively expensive transistor having a high power rating. However, even with use of such a transistor the destruction of the power output transistor and therefore a malfunction of the whole ignition system cannot always be prevented.

In another known system, described in DE-OS 2 406 018, the current through the primary winding is interrupted completely when the voltage across the resistor reaches the above-mentioned predetermined voltage. At the same time, a circuit connected in parallel to the primary winding is switched to the conductive state allowing a discharge current to flow. The primary circuit remains in the cutoff state and the parallel circuit in the conductive state either for a predetermined time interval or until such time as the discharge current becomes less than a predetermined minimum value. This system has a disadvantage that two power transistors may have to be provided in the circuit of the primary winding of the ignition coil and also that special control circuits must be provided for an electric switch in the parallel circuit.

THE INVENTION

It is an object of the present invention to furnish an ignition system for internal combustion engines in which the current regulation is such that the power dissipated in the power output transistor is decreased and that on the other hand a simple inexpensive and reliable control circuit for the power transistors is provided.

In accordance with the present invention, regulator means are provided for furnishing a control signal designed to decrease the primary current to the current control means (e.g. the power output transistor) in response to a current limit signal, i.e. the above-mentioned predetermined voltage across the resistor. Further, the power transistor is switched back to a fully conductive state when the voltage across the primary winding exceeds a maximum allowable voltage less than the predetermined critical voltage required to produce a spark.

In a preferred embodiment, a series circuit including a resistor and a capacitor is connected in parallel to the emitter-collector circuit of the power output transistor. This causes the on-off switching cycle to have a longer period thereby decreasing the losses in the transistor itself even further.

DRAWING DESCRIBING A PREFERRED EMBODIMENT

FIG. 1 is a circuit diagram of a preferred embodiment of an ignition system in accordance with the present invention;

FIG. *2a–2f* are schematic timing diagrams for explaining the operation of the known and present systems.

The ignition system shown in FIG. 1 is energized by a battery whose positive terminal is connected through a switch S which is normally closed to one terminal of a primary winding L1 of an ignition coil Z. The other terminal of primary winding L1 is connected through a series circuit including the collector-emitter circuit of a power transistor T4 and a precision resistor R12 with the negative terminal of battery B. The negative terminal of battery B is connected to a reference potential, for example ground potential. The positive terminal of the battery is further connected through switch S to the anode of a diode D1 whose cathode is connected through a resistor R1 with a circuit point A. Circuit point A is connected to the reference potential through a capacitor C1. An ignition timing circuit ST is connected between circuit point A and reference potential and has an input to which are applied the signals from a timing signal generator G. The timing signal generator G is indicated as being a mechanical signal generator. However, a contact-less generator such as an inductive generator could also be utilized. The output of ignition timing circuit ST is connected to the anode of a diode D2 whose cathode is directly connected to the base of transistor T4.

The common point of precision resistor R12 and the emitter of transistor T4 is connected through a resistor R10 with a base of a transistor T3. The emitter of transistor T3 is directly connected to the reference potential, while its collector is connected through a series circuit including two resistors R4, R5 to circuit point A. The common point of resistors R4 and R5 is connected to the base of a further transistor T2. This common point is denoted by reference number B. Transistor T2 is an npn transistor while the remaining transistors are all pnp transistors. The emitter of transistor T2 is directly connected to circuit point A while its collector is connected through a series circuit including resistors R2 and R3 to reference potential. The common point C of resistors R2 and R3 is connected to the base of a transistor T1, whose emitter is directly connected to reference potential and whose collector is directly connected to the output of circuit ST. A capacitor C3 is connected parallel to resistor R6. A capacitor C2 is connected parallel to resistor R7. A series circuit including a resistor R13 and a capacitor C4 is connected in parallel to the collector-emitter circuit of transistor T4. A series circuit including a Zener diode ZD2 and a resistor R8 is connected in parallel to the collector-base circuit of transistor T4, while a resistor R9 is connected in parallel to the emitter-base circuit. The end of primary winding L1 of ignition coil Z which is connected to the collector of transistor T4 is also connected through a resistor R11, a Zener diode ZD1, and a diode D3 to circuit point B. One terminal of a secondary winding L2 of ignition coil Z is connected to the collector of transistor T4. The other terminal of the secondary winding is connected to at least one spark plug. The connection may be made through a distributor. Finally, a diode D4 is connected in parallel to resistor R4.

Operation

Diode D1 constitutes a protection against application of voltages of a wrong polarity. Resistor R1 limits the current to the ignition timing circuit and the control circuit of the present invention. Capacitor C1 is a filtering capacitor. It filters the voltage at circuit point A. Ignition timing circuit ST operates in known fashion and, upon receipt of the signals from generator G, furnishes rectangularly shaped output pulses which determine the open and closed time of power transistor T4. Power transistor T4 acts as an interrupter.

The circuit including resistor R12, transistors T1–T3 and the circuit elements associated therewith as well as the series circuit of diode D3, Zener diode ZD 1 and resistor R11 operates in conventional fashion until the current through resistor R12 has reached the predetermined value which is required for sufficient energy storage in ignition coil Z. However, as soon as this predetermined amplitude of current flows through resistor R4 and thereby generates a predetermined voltage drop across this resistor, the voltage resulting at the common point of resistors R7 and R10 is such as to cause transistor T3 to become conductive. When transistor T3 becomes conductive, base current for transistor T2 can flow through resistor R5. Transistor T2 therefore switches to the conductive state. The resultant voltage at circuit point C, namely the common point of resistors R2 and R3, is such as to cause transistor T1 to become conductive. Transistor T1 now completely shunts the base current from transistor T4 so that transistor T4 would block fully if sufficient time were available, and would not, as was conventional previously, merely be switched to a state of lesser conductivity by a decrease of base current.

Because of the loss of base current of transistor T4, the voltage across primary winding L1 of ignition coil Z increases steeply until a maximum allowable voltage less than the voltage required to generate a spark is reached. At this point Zener diode ZD1 becomes conductive and allows a voltage to be applied to the base of transistor T2 which causes this transistor to block. The base current for transistor T1 can no longer flow through the emitter-collector circuit of Transistor T2. Transistor T1 blocks almost simultaneously with transistor T2. The output voltage of ignition timing circuit ST is again fully applied to the base of transistor T4. Transistor T4 switches back to a fully conductive state. This causes the current through transistor T4 to jump to a starting value which depends upon the residual energy in primary winding L1. Since coil losses are unavoidable, the current in the winding is less than the current value was at cutoff (e.g. 6.5 and 7 amps., respectively. The current starts to increase until the predetermined value is again reached. The process repeats cyclically at a frequency which is sufficiently high that transistor T4 does not have time to block completely. When the closure time determined by the width of the rectangular pulse generated in circuit ST is over, a final blocking of transistor T4 occurs. Of course, if Transistor T4 is already in the blocked state, the absence of the output signal from circuit ST maintains it in such a blocked state. At the end of the closure signal furnished by ignition timing circuit ST, a spark is therefore generated.

In the above explanation of the operation of the circuit of FIG. 1, the series circuit including resistor R13 and capacitor C5 has been neglected. The addition of this series circuit results in a great increase of the otherwise relatively small losses in coil Z during the time that transistor T4 is blocked. This in turn causes a lengthening of the switching cycle and thereby a further reduction of the power dissipated in transistor T4. Specifically, capacitor C5 is charged through resistor R13 each time that transistor T4 is blocked and then is discharged each time transistor T4 returns to the conductive state. This causes relatively large losses to be generated in resistor R13, substantially decreasing the power dissipated in transistor T4. The losses in transistor T4 can be reduced to the point where they are true switching losses.

Resistor R6 and capacitor C3 constitutes a positive feedback path for improving the switching behavior when transistor T3 becomes conductive at the time the predetermined current value is reached and in turn causes transistor T2 to become conductive. On the other hand, capacitor C2 keeps transistor T3 conductive even when the voltage across resistor R12 decreases to approximately zero upon switching of transistor T1 to the conductive state. The value of capacitor C2 is selected in conjunction with the resistance values of resistors R6, R7 and R10 to be such that transistor T3 remains in the conductive state until transistor T2 is blocked by the voltage generated across primary winding L1 and the breakdown of Zener diode ZD1. Finally, it should be mentioned that Zener diode ZD2 and resistor R8 protect transistor T4 from overvoltages during ignition and that diodes D2, D3 and D4 are blocking diodes. Resistor R11 limits the current when Zener diode ZD1 becomes conductive. Further, resistor R9 provides a path for charge carriers upon blocking of transistor T4.

Figure 2:
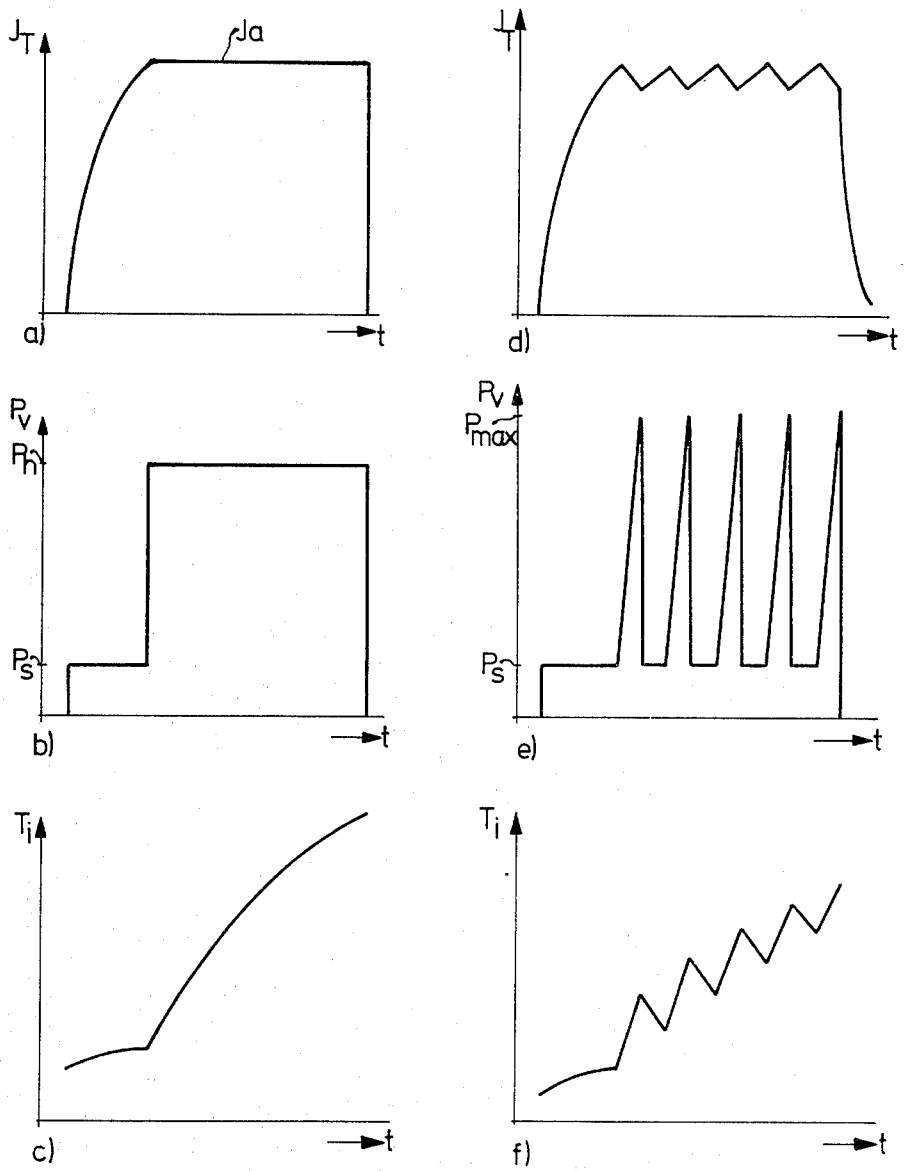

The above conditions can be visualized more readily with reference to the diagrams of FIG. 2. FIGS. 2*a*–2*c* refer to a conventional ignition stage and show, respectively, the current through transistor T4, the power dissipated in transistor T4 and the variation of temperature of transistor T4 with respect to time t. FIGS. 2*d*, 2*e* and 2*f* show the corresponding values for an ignition system shown in FIG. 1, that is the ignition system of the present invention. Again, FIG. 2*d* shows the variation of current with respect to time, FIG. 2*e* shows the variation of power dissipation with respect to time and FIG. 2*f* shows the variation of temperature with respect to time of transistor T4 when the system of the present invention is utilized. It will be noted that the current $I_t$ is maintained at a constant value $I_a$ in the known system, while in accordance with the present invention, the value oscillates between the cutoff current $I_a$ and a lower limiting value $I_g$ after the predetermined current value has been reached. The changes between current values, that is the changes between increasing and decreasing current occur with a relatively high frequency, so that current continues to flow through transistor T4 even though a blocking potential, that is a potential adequate for completely blocking the emitter-collector current is applied to its base. Current flow is not completely blocked through transistor T4 until the actual ignition time is reached.

Referring now to FIG. 2*b* and 2*e*, for the conventional system, a relatively small power loss $P_s$ takes place until the predetermined current $I_a$ is reached. This is because the voltage across the transistor is, up to that time, a saturation voltage. During the time the current is controlled to the constant value $I_a$, a high power loss $P_h$ occurs. In contrast to this, the power dissipated in the transistor T4 controlled in accordance with the present invention after the current $I_a$ is reached reaches a peak $P_{max}$ which is higher than the power loss $P_h$. On the other hand between peaks the power dissipated decreases back to the power loss $P_s$, during the time that the current increases, so that an average loss $P_v$ considerably lower than the power loss $P_h$ results. This is also clearly illustrated in FIGS. 2*c* and 2*f*. Reference to these two figures makes it clear that the temperature rise in transistor T4 controlled in accordance with the present invention is considerably less than that of the same transistor driven by the conventional circuitry.

Various changes and modifications may be made within the scope of the inventive concepts.

I claim:

1. In an internal combustion engine having an ignition system having an ignition coil with a primary winding (L1) and a secondary winding (L2), spark creating means connected to said secondary winding for generating a spark when the voltage across said primary winding exceeds a predetermined critical voltage, controllable current control means (T4) connected to said primary winding for controlling current flow therethrough during an interval immediately preceding said generation of said spark so that sufficient energy is stored in said ignition coil when said spark is generated, and current sensing means (R12) connected to said primary winding for furnishing a current limit signal when the current through said primary winding exceeds a predetermined current corresponding to said sufficient energy, a system for decreasing the average current consumption of said current control means comprising regulator means (T1–T3) connected to said current control means and said current sensing means and operative only during said interval, and comprising means ($T_1$, $T_3$) for furnishing a control signal designed to decrease said current through said primary winding to said current control means in response to said current limit signal, and means ($ZD_1$, $T_2$) for switching said current control means back to a fully conductive state when the voltage across said primary winding exceeds a maximum allowable voltage less than said predetermined critical voltage.

2. An internal combustion engine as set forth in claim 1, wherein said control signal is a blocking signal designed to switch said current control means to a blocked state.

3. An internal combustion eneine as set forth in claim 2, wherein said current control means comprises a transistor having an emitter-collector circuit connected in series with said primary winding and a base connected to said regulator means.

4. An internal combustion engine as set forth in claim 3, wherein said regulator means comprises means for repeatedly furnishing said control signal and switching said current control means back to a fully conductive state during said interval.

5. An internal combustion engine as set forth in claim 3, wherein said means for furnishing a control signal comprises means for shunting current away from said base of said transistor; and wherein said means for switching said current control means back to a fully conductive state comprises means ($T_2$, $ZD_1$) for blocking the operation of said shunting means when said voltage across said primary winding exceeds said maximum allowable voltage.

* * * * *